US010435998B2

(12) United States Patent
Balun et al.

(10) Patent No.: US 10,435,998 B2
(45) **Date of Patent: *Oct. 8, 2019**

(54) OUTER TUBE FOR A PERFORATING GUN

(71) Applicant: BENTELER STEEL/TUBE GMBH, Paderborn (DE)

(72) Inventors: Jozef Balun, Paderborn (DE); Waldemar Engel, Paderborn (DE)

(73) Assignee: Benteler Steel/Tube GmbH, Paderborn (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/898,626

(22) Filed: Feb. 18, 2018

(65) Prior Publication Data

US 2018/0179865 A1 Jun. 28, 2018

Related U.S. Application Data

(63) Continuation of application No. 15/137,892, filed on Apr. 25, 2016, now Pat. No. 9,896,915.

(51) Int. Cl.

| | |
|---|---|
| ***E21B 43/116*** | (2006.01) |
| ***F42D 1/02*** | (2006.01) |
| *F42D 1/00* | (2006.01) |

(52) U.S. Cl.

CPC ..... *E21B 43/116* (2013.01); *F42D 1/02* (2013.01); *F42D 1/00* (2013.01)

(58) Field of Classification Search

CPC ..... E21B 43/116–119; F42D 1/00–055; F42D 5/045

USPC ..... 89/1.15; 102/305–306, 311–314, 102/319–324

See application file for complete search history.

(56) References Cited

U.S. PATENT DOCUMENTS

| | | | | |
|---|---|---|---|---|
| 3,048,102 | A | 8/1962 | Lebourg | |
| 3,605,777 | A | 9/1971 | Curry et al. | |
| 4,919,050 | A | 4/1990 | Dobrinski et al. | |
| 4,966,750 | A * | 10/1990 | LaSalle | C22C 43/00 102/306 |
| 6,302,027 | B1 * | 10/2001 | Compton | B32B 27/08 102/323 |

(Continued)

FOREIGN PATENT DOCUMENTS

WO WO 2014/182304 11/2014

OTHER PUBLICATIONS

Official Action for U.S. Appl. No. 14/863,070, dated Aug. 8, 2016 19 pages.

(Continued)

*Primary Examiner* — Stephen Johnson
*Assistant Examiner* — Benjamin S Gomberg
(74) *Attorney, Agent, or Firm* — Sheridan Ross PC

(57) ABSTRACT

An outer tube for a perforating gun is provided that includes an inner wall and an outer wall and also a wall thickness (D) and a length (L), wherein the outer tube has a hardness over its entire longitudinal extent along the length (L) and its transverse extent along the wall thickness (D), wherein the hardness of the outer tube is reduced, in at least one region, to an extent (T) measured from the outer wall to the inner wall, wherein, in this region, the outer tube has a reduced hardness (HV) on its outer wall, said reduced hardness being reduced in this region by at least 5% in relation to the hardness (H) of the inner wall.

20 Claims, 2 Drawing Sheets

(56) References Cited

U.S. PATENT DOCUMENTS

| | | | | |
|---|---|---|---|---|
| 6,464,019 | B1 * | 10/2002 | Werner | E21B 43/117 102/307 |
| 6,702,039 | B2 | 3/2004 | Parrott et al. | |
| 6,941,871 | B2 | 9/2005 | Mauldin | |
| 8,794,326 | B2 | 8/2014 | Le et al. | |
| 9,896,915 | B2 * | 2/2018 | Balun | E21B 43/116 |
| 2002/0134585 | A1 | 9/2002 | Walker | |
| 2002/0189483 | A1 | 12/2002 | Parrott et al. | |
| 2003/0188867 | A1 | 10/2003 | Parrott et al. | |
| 2005/0139352 | A1 | 6/2005 | Mauldin | |
| 2009/0050334 | A1 * | 2/2009 | Marya | C23C 8/00 166/376 |
| 2009/0288833 | A1 * | 11/2009 | Graham | E21B 7/046 166/306 |
| 2010/0300750 | A1 | 12/2010 | Hales et al. | |
| 2014/0041515 | A1 | 2/2014 | Mauldin | |
| 2014/0053715 | A1 | 2/2014 | Zhang et al. | |
| 2015/0152704 | A1 * | 6/2015 | Tunget | E21B 33/128 166/254.2 |
| 2015/0285026 | A1 * | 10/2015 | Frazier | E21B 33/1291 166/120 |
| 2016/0024624 | A1 * | 1/2016 | Cheney | C22C 32/0052 420/100 |
| 2017/0028437 | A1 * | 2/2017 | Holly | E21B 43/116 |
| 2017/0081948 | A1 * | 3/2017 | Balun | E21B 43/116 |
| 2017/0101693 | A1 * | 4/2017 | Lomker | C21D 9/14 |
| 2017/0107799 | A1 * | 4/2017 | Rodgers | E21B 43/116 |

OTHER PUBLICATIONS

Official Action for U.S. Appl. No. 14/863,070, dated Apr. 21, 2017 13 pages.

Notice of Allowance for U.S. Appl. No. 14/863,070, dated Jun. 30, 2017 7 pages.

Official Action for U.S. Appl. No. 15/137,892, dated May 18, 2017 13 pages.

Notice of Allowance for U.S. Appl. No. 15/137,892, dated Dec. 5, 2017 10 pages.

* cited by examiner

Figure 1
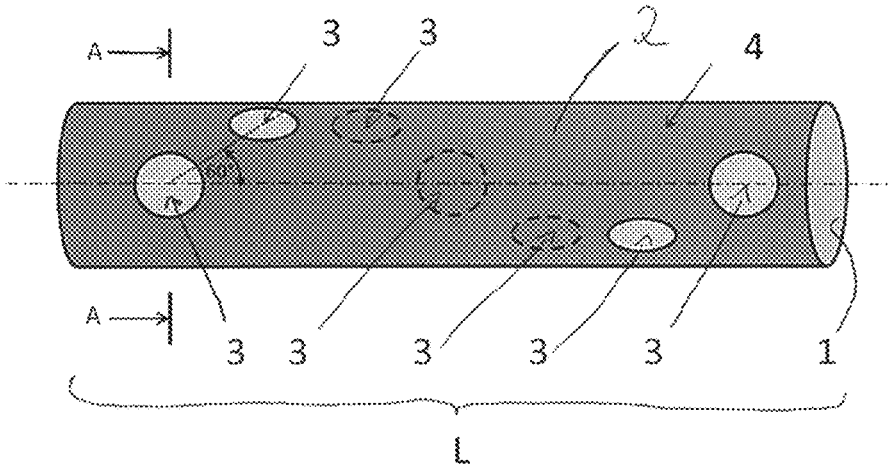
Figure 2 - Prior Art
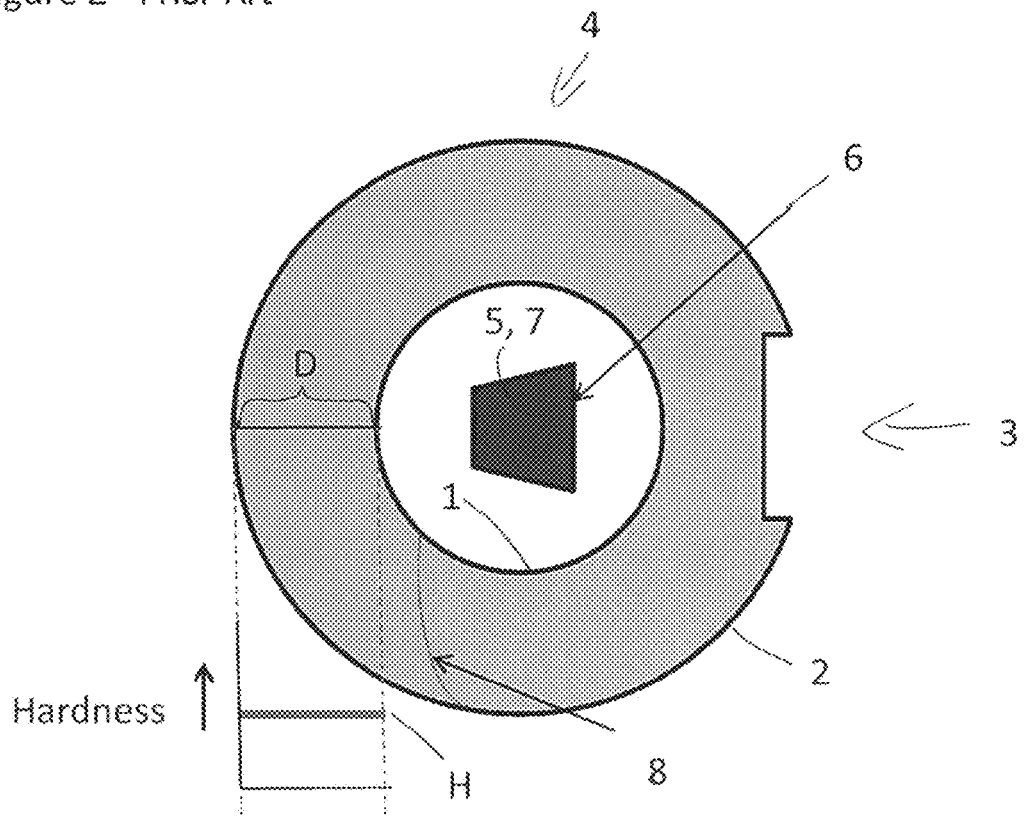

OUTER TUBE FOR A PERFORATING GUN

CROSS REFERENCE TO RELATED APPLICATION

This application is a continuation of U.S. patent application Ser. No. 15/137,892, filed Apr. 25, 2016, and issued as U.S. Patent No. 9,896,915 on Feb. 20, 2018, entitled "OUTER TUBE FOR A PERFORATING GUN", the entirety of which is incorporated herein by reference.

FIELD

The invention relates to an outer tube for a perforating gun. The invention also relates to a perforating gun having such an outer tube.

BACKGROUND

Such perforating guns are used in particular in production wells for the exploration and production of crude oil by means of so-called fracking. In fracking, a medium is introduced under pressure, via a delivery line, into deep, porous layers of earth in order thus to release gas or oil bound in the layers of earth. In order to perforate the well or the protective or delivery tube, also referred to as a casing, and to increase the porosity and extend the period of production of a well, subterranean explosions are carried out by means of a perforating gun. A perforating gun here comprises an outer tube which is provided with a multiplicity of depressions, acting as perforations, and in which is arranged an inner part, which has holders carrying explosive charges.

These explosive charges are arranged in the perforating gun such that, when they are detonated, the result is a multiplicity of jets which penetrate the perforations in the outer tube, and the jets run radially into the layer of earth and likewise perforate, or break up, the same. The medium which is to be produced can then be produced more easily and productively through the perforations or as a result of the layers of earth being broken up in this way. On the one hand, it is necessary for the outer tube of such a perforating gun to withstand a high compression pressure, which becomes established on account of the earth masses at depth. On the other hand, it is nevertheless also necessary to ensure that the outer tube is not damaged by these explosions. In particular it has to remain free of deformation, or at least must not undergo inadmissible widening, in the event of the explosions, so that it remains possible for the outer tube or the perforating gun to be removed from the well or from the casing. Such a perforating gun is described, for example, in U.S. Pat. No. 8,794,326 B2.

US 2014/0041515 A1 and WO 2014/182304 A1 deal with the optimization of the design and the production of the depressions and/or perforations in the outer tube of the perforating gun.

US 2002/0189483 A1 describes the mechanical loading to which the outer tube is subjected during detonation of the explosive charges of a perforating gun and during propagation of the jets. During the propagation of the pressure waves by way of the jets making contact with the outer tube, there is the problem of the outer tube being damaged and therefore of the removal of the outer tube, or of the perforating gun as a whole, from the well or casing being difficult as a result of the outer contour of the outer tube of the perforating gun being changed. US 2002/0189483 A1 thus proposes optimization of the design of the depressions or perforations in order to have a positive influence on the jet propagation itself and on the propagation of the pressure waves. However, it is also the case here that satisfactory results are not achieved, since the outer contour of the outer tube of the perforating gun can still be damaged, and therefore the removal of the perforating gun from the well continues to be a problem. Furthermore, the explosions initiate cracks on the outer contour of the outer tube of the perforating gun, and said cracks can result in deformation of the outer contour of the outer tube.

SUMMARY

It is therefore an object of the invention to improve an outer tube for a perforating gun to the extent where such undesired cracks no longer occur on the outer contour of the outer tube during detonation of the explosive charges of the perforating gun. Since this tendency to cracking also increases at higher strength, it is an additional object of the invention to configure the outer tube of the perforating gun such that stronger explosive charges can be fired thereby without the strength and dimensions and the outer tube necessarily being increased. This is because the wall thickness and the outer circumference of the outer tube cannot be increased as desired in order to increase the loading capability of the outer tube; this is because wells of different dimensions would have to be produced for this purpose. It is also an object of the invention to make available a perforating gun having such an outer tube.

In respect of the outer tube for a perforating gun, the object is achieved by an outer tube having all the features of patent claim 1. In respect of the perforating gun, the object is achieved by a perforating gun having all the features of patent claim 11. Advantageous configurations of the invention can be found in the dependent claims.

The outer tube for a perforating gun according to the invention here has an inner wall and an outer wall and is formed with a wall thickness D and a length L. It should be stated here that the length of the outer tube is greater by at least a factor of 100 than the wall thickness of the outer tube. The length of the outer tube can range between 20 centimeters and 700 centimeters. The wall thickness of the outer tube is preferably between 3 and 30 millimeters. The external diameter may be between 30 and 200 millimeters. The outer tube here has a hardness over its entire longitudinal extent along the length L and its transverse extent along the wall thickness D. According to the invention, then, provision is made for the hardness of the outer tube to be reduced, in at least one region, to an extent measured from the outer wall to the inner wall, wherein, in this region, the outer tube has a reduced hardness HV on its outer wall, said reduced hardness being reduced in this region by at least 5% in relation to the hardness H of the inner wall.

As a result of this reduced hardness on the outer wall of the outer tube, it is not possible for cracking to occur from the outer wall, and therefore the perforating gun can readily be removed, with its undamaged outer tube, from the penetrated protective tube. In particular, the invention makes it possible for use to be made within the perforating gun, which is provided with an outer tube serving as a tubular housing and with an inner part, which is arranged in the outer tube and has holders carrying explosive charge, of stronger explosive charges and it is therefore possible to achieve a considerable increase in the efficiency of the perforation of the protective tube and in the production of holes in the solid medium (e.g. shale or the like), in which the medium which is to be produced is stored. This ensures that the outer tube of the perforating gun does not crack during and following detonation of the explosive charges and can thus be removed easily from the well or casing. To this extent, the invention can also achieve a higher production rate, without larger-dimension wells having to be provided.

The at least one region of reduced hardness on the outer wall of the outer tube makes it possible to avoid overlapping of shock waves, which is critical for crack initiation, by virtue of this propagation of the shock waves being influenced specifically by the reduced hardness of the outer tube on its outer wall. Pressure waves here act radially on the wall surface of the outer tube in and counter to the direction of jet propagation following detonation of the explosive charges. This also means, however, that shear waves or shear-wave fractions, which continue clockwise and counterclockwise in the circumferential direction of the wall surface, occur at the point of contact, wherein the reduced hardness means that a greater proportion of the energy of these waves is absorbed by the outer tube without the outer tube being damaged. Cracks typically occur in an outer region in the cross section of the outer tube. In the case of so-called 60°-phase perforating guns, cracks occur, as seen in the region between 60° and 120°, at an angle stemming from the jet-propagation direction, and therefore preferably a reduced hardness is established in this region. If a shear wave then comes into contact with a region of reduced hardness of the outer tube, then this shear wave is partially absorbed by local structural deformation. The unobstructed propagation of the shear wave is thus impeded, at least in part, such that cracking no longer takes hold on the outer contour of the outer tube. As a result, even in extremely deep layers of earth, the outer tube withstands a high compression pressure which prevails there, wherein the structural integrity of the outer tube is not weakened. In addition, the configuration of the outer tube according to the invention, in particular if the outer tube has a plurality of regions of reduced hardness, also makes it possible to use considerably stronger explosive charges, and therefore this also achieves an increase in the efficiency of the perforation, and excessive stressing in the outer tube, which leads to failure, is avoided. By virtue of a corresponding arrangement of the regions of reduced hardness in the outer wall of the outer tube, it is thus possible to control, and also weaken, the propagation of the waves, in particular of the shear waves, both along the length of the tube and in a circumferential direction, and therefore this too, once again, counteracts cracking on the outer wall or outer contour of the outer tube.

According to a first advantageous configuration of the invention, the outer tube here consists of a metal, preferably of a steel, particularly preferably of a high-strength steel. Such materials have also proven successful hitherto for use in outer tubes of perforating guns.

It has also proven to be advantageous that the extent to which the hardness of the outer tube is reduced is at least 200 μm and at most 50% of the wall thickness of the outer tube. This is because it has been found that an extent of 200 μm for the reduced hardness of the outer tube reduces cracking on the outer contour or outer wall of the outer tube, wherein it remains possible for the outer tube or the perforating gun to be easily removed from the protective tube with a simultaneous increase in the explosive force of the explosive charges. It is preferred, however, for the extent of the reduced region to be at least 250 μm, this giving greater damage tolerance and greater reliability during operation of the perforating gun. Even if the extent to which the hardness of the outer tube is reduced is increased to up to 50% of the wall thickness of the outer tube, it has been found that the outer tube still has sufficient strength without corresponding cracking occurring on the outer contour or outer wall of the outer tube to the extent which would render removal of the outer tube or of the perforating gun from the protective tube problematic.

It has been found to be particularly advantageous if the reduced hardness HV on the outer wall is reduced by at least 10% in relation to the hardness H on the inner wall. The reduced hardness on the outer wall is reduced here by a maximum of 30% in relation to the hardness H on the inner wall. This is because it has been found that, in the case of a reduction in hardness on the outer wall of between 10% and 30%, the propagation of the shear waves can be correspondingly reduced, and also controlled, by partial structural absorption, and therefore cracking on the outer contour or outer wall of the outer tube is minimized such that straightforward removal of the perforating gun from the protective tube remains possible.

In particular the extent of the region of reduced hardness and the order of magnitude of the reduction in hardness should be selected such that cracking and damage tolerance are sufficient for the requirements of the well. A large reduction by for example 15 to 25% can compensate for a lesser extent of reduced hardness.

In order to achieve an appropriate strength of the outer tube, it has proven to be expedient that the 0.2% offset yield strength $R_{p,0.2}$ of the outer tube is at least 700 MPa, preferably at least 800 MPa, in all regions. Such materials, in particular steels, have already proven successful for use in outer tubes of perforating guns and can also be treated using appropriate methods in order to ensure the regions of reduced hardness in the outer wall or outer contour of the outer tube for the perforating gun. Low-alloy steels or quenched and tempered steels are particularly suitable materials here.

According to the invention, the region of reduced hardness HV is preferably formed over the entire circumference and the entire length of the outer tube.

As an alternative, it is also proven successful for the regions of reduced hardness HV only to be local and to be enclosed all the way around their circumference by portions of a higher level of hardness. Such a configuration of the invention makes it possible for the pressure waves or shear waves produced by detonation of the explosive charges to be controlled appropriately, or for the energy thereof to be absorbed by the outer tube, so that cracking on the outer contour or outer wall of the outer tube is counteracted effectively. The regions of reduced hardness may be arranged, for example, in annular, helical or wave form.

In order to produce the regions of reduced hardness, it has proven successful to carry out a local heat treatment, in particular a local inductive heat treatment, and thus establish the hardness in the region or the regions of the outer tube in accordance with the desired values. The extent of the reduction in hardness of the outer tube can be established very precisely in particular with the aid of a high-frequency local inductive heat treatment. Local should be understood, within the context of the invention, to mean that the hardness in the wall thickness is established in the radial direction. In addition to such a local heat treatment, however, it is also possible for the region of reduced hardness to be established by means of deep decarburization. This is because a correspondingly desired reduction in hardness is also achieved by a reduction in the carbon content of the steel of the outer tube.

The outer tube for the perforating gun is provided here with a multiplicity of depressions which extend radially from the outer wall in the direction of the inner wall. The jets produced by the detonation of the explosive charges of the perforating gun are directed through such depressions, wherein these jets cause the protective tube to be perforated and the solid medium in which the medium which is to be produced is stored to be broken up or to have holes generated therein. Following removal of the perforating gun from the protective tube, it is then possible to start production of the medium stored in the solid medium. The perforations can be introduced before or after hardness has been established.

It is particularly advantageous according to the invention that the at least one region of reduced hardness is arranged on the outer tube such that it is located outside the depressions. It is thus possible for the jets to be able to propagate radially outward within the depressions and to generate the perforations in the well or casing and the solid medium, but without the outer contour of the outer tube being damaged by the shear waves and pressure waves such that it would no longer be possible to remove the perforating gun from the well.

Further aims, advantages, features and possible uses of the present invention can be gathered from the following description of an exemplary embodiment with reference to the drawing. All the features described and/or illustrated form in themselves, or in any desired appropriate combination, the subject matter of the present invention, irrespective of how they are combined in the claims or how they relate back.

BRIEF DESCRIPTION OF THE DRAWINGS

In the drawing:

FIG. 1 shows a perspective illustration of a possible exemplary embodiment of an outer tube for a perforating gun according to the invention, FIG. 2 shows a cross-sectional illustration of an outer tube according to the prior art.

DETAILED DESCRIPTION

Figure 3:
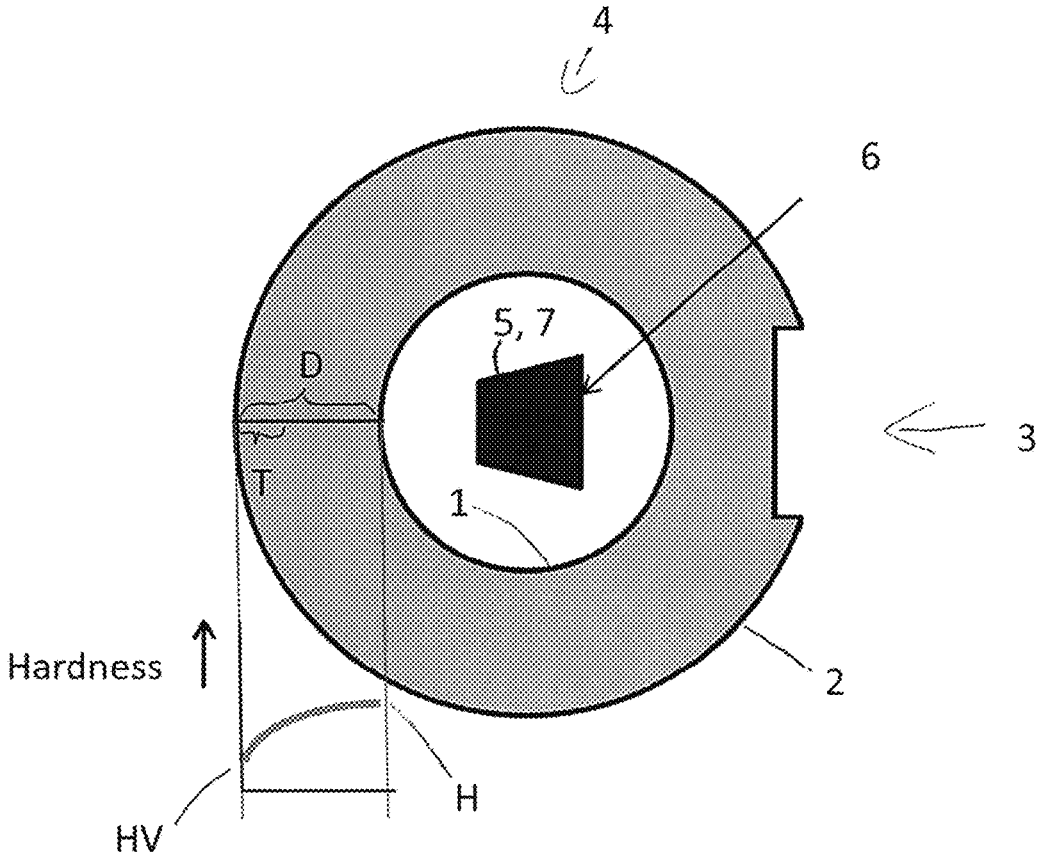
FIG. 3: shows a cross-sectional illustration of the outer tube according to the invention from FIG. 1.

FIG. 1 illustrates a possible exemplary embodiment of an outer tube for a perforating gun according to the invention. The outer tube here has an inner wall 1 and an outer wall 2, wherein the outer wall has a wall thickness D and a length L. Such an outer tube for a perforating gun serves, at the same time, as a housing 4 for the perforating gun.

As can be gathered from FIG. 1, depressions 3 are arranged on the outer wall 2 of the outer tube, each offset, in particular helically, through 60°. This outer tube is also referred to as a 60°-phase perforating gun.

The outer tube, which serves as a housing 4 for the perforating gun, has introduced into it an inner part 5, which contains holders 7 for explosive charges 6, said holders being offset helically through 60° in a manner corresponding to the depressions 3 on the outer wall 2 of the outer tube. In other words, it is also the case that the explosive charges 6 and/or the holders 7 of the inner part 5 are arranged within the outer tube, serving as a housing 4 for the perforating gun, in a manner in which they are offset through 60° in each case in relation to one another.

FIG. 2 shows such an arrangement for an outer tube of a perforating gun as is known from the prior art. The outer tube for the perforating gun, said outer tube serving as housing 4, has a wall thickness D here, wherein the hardness of the wall has a constant value H over its entire wall thickness D.

FIG. 2 shows this at the bottom left with a corresponding diagram, which illustrates the hardness of the outer tube as a constant value H over the wall thickness D of the outer tube. It is evident from this that the hardness of the material of the outer tube, usually produced from a steel, within the outer tube has the constant hardness value H over the entire wall thickness D from the outer wall 2 to the inner wall 1.

If, then, use is made, within the holders 7 of the inner part 5, of explosive charges 6 which exceed a certain explosive force, this gives rise, on account of the propagation of shear waves and pressure waves within the outer tube, to overlapping of said shear waves and pressure waves in the outer tube between the inner wall 1 and the outer wall 2. This results in points of failure 8. The breakage or crack in the outer tube starts here on the outer wall 2 of the outer tube and propagates to the inner wall 1 of the outer tube. In the worst-case scenario, this can result in plastic deformation of the outer tube as a whole, and it is therefore no longer possible for said outer tube, or the perforating gun as a whole, to be removed from the protective tube within the well.

FIG. 3 illustrates the outer tube according to the invention from FIG. 1 in a cross-sectional illustration taken along plane A-A from FIG. 1. Here too, the outer tube, which serves as a housing 4 for the perforating gun, has arranged within it an inner part 5, which has holders 7, which correspond to the depressions 3 and in which explosive charges 6 may be arranged. It is also the case here that the outer tube according to the invention has a wall thickness D, as is also given in the prior art according to the illustration of FIG. 2. However, in the case of the outer tube according to the invention, the hardness is not constant over the wall thickness D of the outer tube. Rather, the hardness is reduced by at least 5%, in the region of the outer wall, to an extent T. In other words, the outer tube for the perforating gun according to the invention has a hardness which decreases from the inner wall 1 to the outer wall 2. The reduced hardness HV on the outer wall 2 of the outer tube should be a maximum of 95% of the hardness H on the inner wall 1 of the outer tube. FIG. 3 uses a corresponding diagram at the bottom left to illustrate the hardness of the outer tube over its wall thickness. It is clearly evident here that the hardness of the outer tube decreases continuously over its wall thickness D from the hardness H on the inner wall 1 to the hardness HV on the outer wall 2 of the outer tube.

Such a drop in hardness from the inner wall to the outer wall can be achieved, for example, by high-frequency inductive heat treatment or deep decarburization. As a result of the reduction in the hardness to the value HV, the tendency of the outer tube to fail is less than in outer tubes of constant hardness H. To this extent, in the case of the outer tube according to the invention, it is also possible to use considerably stronger explosive charges, as a result of which deeper-level perforation of the rock or earth is achieved, and this results in a higher level of efficiency or in a higher production rate per source or per explosion.

The regions of reduced hardness HV on the outer wall 2 of the outer tube may be arranged individually on the outer tube. However, it is also possible for these regions of reduced hardness to be used over the entire outer tube. It is also possible for regions of reduced hardness HV to be arranged over the circumference of the outer tube adjacent to regions of non-reduced hardness H. In particular, it is also preferred for those regions of the outer tube which are located opposite the depressions 3 to be provided with reduced hardness HV on the outer wall of the tube.

LIST OF REFERENCE SIGNS

1 Inner wall
2 Outer wall
3 Depression
4 Housing
5 Inner part
6 Explosive charge
7 Holder
8 Point of failure
H Hardness
HV Reduced hardness
D Wall thickness
L Length
T Extent

What is claimed is:

1. An outer tube for a perforating gun, comprising:

an inner wall and an outer wall and also a wall thickness and a length, a reduced hardness in at least one region of the outer wall, said reduced hardness extending into the wall thickness by an extent measured from the outer wall to the inner wall, said reduced hardness is at least 5% less than a hardness of the inner wall; and wherein the at least one region having the reduced hardness is established by a local heat treatment such that the hardness across the wall thickness in the at least one region having reduced hardness decreases continuously from the inner wall to the outer wall.

2. The outer tube as claimed in claim 1, comprising a metal.

3. The outer tube as claimed in claim 2, comprising at least one of a steel and a steel alloy.

4. The outer tube as claimed in claim 1, wherein the extent measured from the outer wall to the inner wall is at least 200 μm and at most 50% of the wall thickness.

5. The outer tube as claimed in claim 4, wherein the reduced hardness of the outer wall is at least 10% less than the hardness of the inner wall.

6. The outer tube as claimed in claim 4, further comprising a 0.2% offset yield strength Rp,0.2 of at least 700 MPa.

7. The outer tube as claimed in claim 4, wherein the at least one region having the reduced hardness is only local and is enclosed all the way around a circumference thereof by regions of the outer wall with a hardness greater than the reduced hardness.

8. The outer tube as claimed in claim 4, further comprising:

a multiplicity of depressions which extend radially from the outer wall in a direction of the inner wall.

9. The outer tube as claimed in claim 1, wherein the reduced hardness of the outer wall is at least 10% less than the hardness of the inner wall.

10. The outer tube as claimed in claim 9, further comprising a 0.2% offset yield strength Rp,0.2 of at least 700 MPa.

11. The outer tube as claimed in claim 9, wherein the at least one region having the reduced hardness is only local and is enclosed all the way around a circumference thereof by regions of the outer wall with a hardness greater than the reduced hardness.

12. The outer tube as claimed in claim 9, further comprising:

a multiplicity of depressions which extend radially from the outer wall in a direction of the inner wall.

13. The outer tube as claimed in claim 1, further comprising a 0.2% offset yield strength Rp,0.2 of at least 700 MPa.

14. The outer tube as claimed in claim 13, wherein the at least one region having the reduced hardness is only local and is enclosed all the way around a circumference thereof by regions of the outer wall with a hardness greater than the reduced hardness.

15. The outer tube as claimed in claim 1, wherein the at least one region having the reduced hardness is only local and is enclosed all the way around a circumference thereof by regions of the outer wall with a hardness greater than the reduced hardness.

16. The outer tube as claimed in claim 1, wherein the local heat treatment is a local inductive heat treatment which takes place at high frequency.

17. The outer tube as claimed in claim 1, further comprising:

a multiplicity of depressions which extend radially from the outer wall in a direction of the inner wall.

18. The outer tube as claimed in claim 17, wherein the at least one region having the reduced hardness is arranged outside the depressions.

19. A perforating gun having an outer tube as claimed in claim 1 serving as a tubular housing, comprising:

an inner part, which is arranged in the outer tube; and holders carrying explosive charges.

20. The outer tube as claimed in claim 1, further comprising:

a non-reduced hardness in at least one region of the outer wall, said non-reduced hardness extending through the entire wall thickness such that said non-reduced hardness is substantially the same as the hardness of the inner wall.

* * * * *